United States Patent [19]

Bonvallet

[11] Patent Number: 4,777,915

[45] Date of Patent: Oct. 18, 1988

[54] VARIABLE LIFT ELECTROMAGNETIC VALVE ACTUATOR SYSTEM

[75] Inventor: Duane J. Bonvallet, Ann Arbor, Mich.

[73] Assignee: General Motors Corporation, Detroit, Mich.

[21] Appl. No.: 944,181

[22] Filed: Dec. 22, 1986

[51] Int. Cl.[4] ..... F01L 9/04; F01L 1/34

[52] U.S. Cl. ..... 123/90.11; 123/90.15

[58] Field of Search ..... 123/90.11, 90.15, 90.16, 123/90.24, 322; 251/65, 129.18, 129.10; 335/273, 266, 268, 256

[56] References Cited

U.S. PATENT DOCUMENTS

| | | | |
|---|---|---|---|
| 2,700,395 | 1/1955 | Young | 251/65 |
| 3,633,869 | 1/1972 | Lehmann | 251/129.18 |
| 3,788,597 | 1/1974 | Ichioka | 251/129.18 |
| 3,882,833 | 5/1975 | Longstaff et al. | 123/90.15 |
| 4,455,543 | 6/1984 | Pischinger et al. | 335/266 |
| 4,515,343 | 5/1985 | Pischinger et al. | 123/90.11 |
| 4,533,890 | 8/1985 | Patel | 335/234 |
| 4,544,986 | 10/1985 | Büchl | 123/90.11 |
| 4,614,170 | 9/1986 | Pischinger et al. | 123/90.11 |

*Primary Examiner*—Willis R. Wolfe, Jr.
*Assistant Examiner*—M. Macy
*Attorney, Agent, or Firm*—R. J. Outland

[57] ABSTRACT

A housing on the cylinder head of an engine operatively supports an upper solenoid and a tubular lower solenoid such that therein working pole faces are opposed to each other for operatively effecting movement of an armature fixed to the free stem end of a poppet valve having its stem extending up through the lower solenoid. Upper and lower springs each have one end thereof positioned in the upper and lower solenoids, respectively, and the lower solenoid has an actuator operatively connected thereto to effect axial position of the lower solenoid relative to the upper solenoid, while the upper solenoid has a lash adjuster operatively associated therewith.

6 Claims, 2 Drawing Sheets

VARIABLE LIFT ELECTROMAGNETIC VALVE ACTUATOR SYSTEM

FIELD OF THE INVENTION

This invention relates to electromagnetic actuators for effecting reciprocable movement of a sliding element such as a valve in an internal combustion engine and, in particular, to a variable lift electromagnetic valve actuator system for an internal combusion engine.

DESCRIPTION OF THE PRIOR ART

Various electromagnetically operating actuators as used, for example, to effect opening and closing movement of a poppet valve, either intake or exhaust, in an internal combustion engine have previously been proposed. For example, there is disclosed in U.S. Pat. No. 4,455,543 entitled "Electromagnetically Operating Actuator", issued June 19, 1984 in the names of Pischinger et al, such an electromagnetically operating actuator that uses three solenoids to effect reciprocating movement of a common armature fixed to the stem end of a poppet valve of an engine. In addition, as another example, there is disclosed in U.S. Pat. No. 4,614,170, entitled "Method of Starting a Valve Regulating Apparatus for Displacement-Type Machines", issued Sept. 30, 1986 to Pischinger et al, such an electromagnetically operating actuator that uses two solenoids to effect reciprocating movement of an armature fixed to a poppet valve and a method for starting operative movement of the armature from an engine non-operating position at which the armature is positioned by opposed springs at a location substantially intermediate the opposed poles of the solenoids.

SUMMARY OF THE INVENTION

The present invention relates to a variable lift electromagnetic valve actuator system for an internal combustion engine, the system including a first or upper solenoid operatively positioned in a multi-piece housing and a second or lower solenoid also positioned in the housing whereby the end surfaces of the two solenoids are opposed to each other whereby an armature, fixed to one end of a poppet valve, can move between the pole end surface of the first solenoid and to the pole end surface of the second solenoid so as to effect opening and closing movement of the poppet valve, with first and second springs abutting against opposite sides of the armature to assist in the above-described movement of the armature. The second or lower solenoid is provided in a preferred embodiment with at least one radially outward extending cam follower that is adapted to extend out through an opening in the housing so as to engage the cam on a cam ring that is positioned so as to loosely encircle the lower end of the housing and which is adapted to be rotated by a stepper actuator, as desired, to raise or lower the second or lower solenoid relative to the first or upper solenoid whereby to vary the lift of the poppet valve during engine operation and to position the armature in closely spaced relationship between the opposed pole end surfaces during engine shut-down whereby the poppet valve can be moved to either a closed position or an open position, as required during the start up again of engine operation.

It is therefore a primary object of this invention to provide an improved electromagnetic actuator wherein two solenoids are used to effect sequential opening and closing movement of a poppet valve (intake or exhaust) having an armature fixed to its stem end and located between the opposed working pole faces or surfaces of the solenoid, with one of the solenoids having an actuator operatively associated therewith to effect axial displacement of that one solenoid relative to the other solenoid whereby to vary the lift of the poppet valve as a function of engine operation.

Another object of the invention is to provide an improved electromagnetic actuator for use with a poppet valve, either intake or exhaust, of an internal combustion engine, the electromagnetic actuator having two opposed solenoids with an armature that is fixed to the poppet valve being operatively positioned between the solenoids and wherein one of the solenoids is axially movable relative to the other solenoid whereby the armature can be mechanically moved into close proximity to the opposed pole faces of the other solenoids during engine shut-down so that the poppet valve can be either opened or closed during start-up of engine operation, and wherein the one solenoid is also movable during engine operation to vary lift of the poppet valve, as desired, as a function of engine operation.

For a better understanding of the invention as well as other objects and further features thereof, reference is had to the following detailed description of the invention to be read in connection with the accompanying drawings.

DESCRIPTION OF A PREFERRED EMBODIMENT

Figure 2:
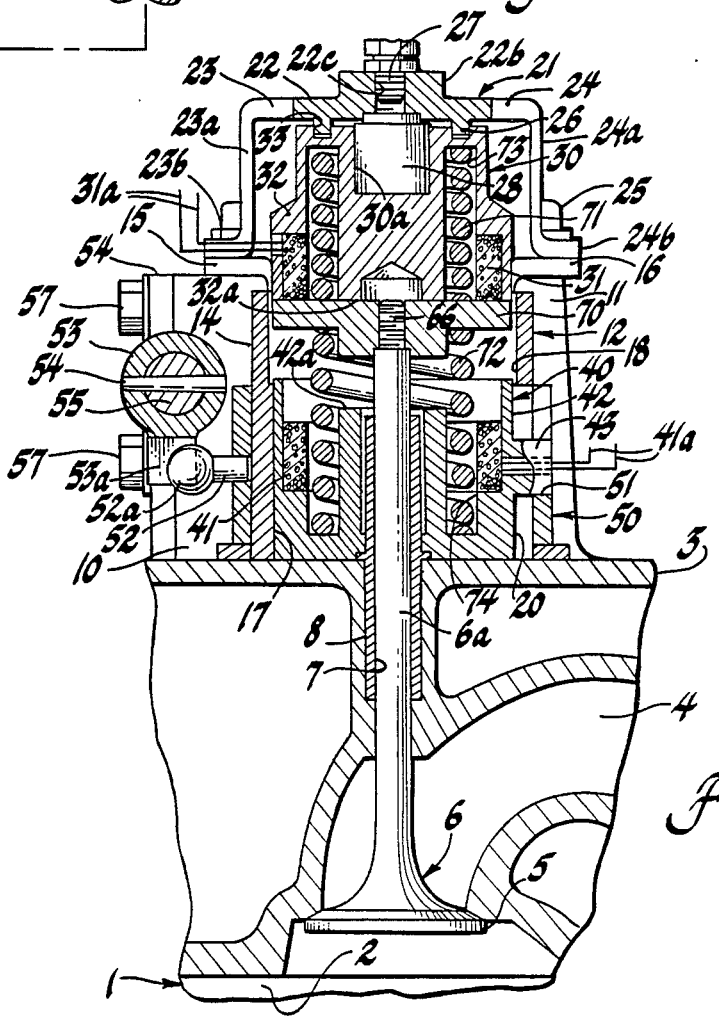
FIG. 2 is a cross-sectional view of the portion of the engine of FIG. 1 taken along line 2—2 of FIG. 1, with the solenoids being illustrated schematically and with the elements thereof being shown in the valve closed position.
Figure 3:
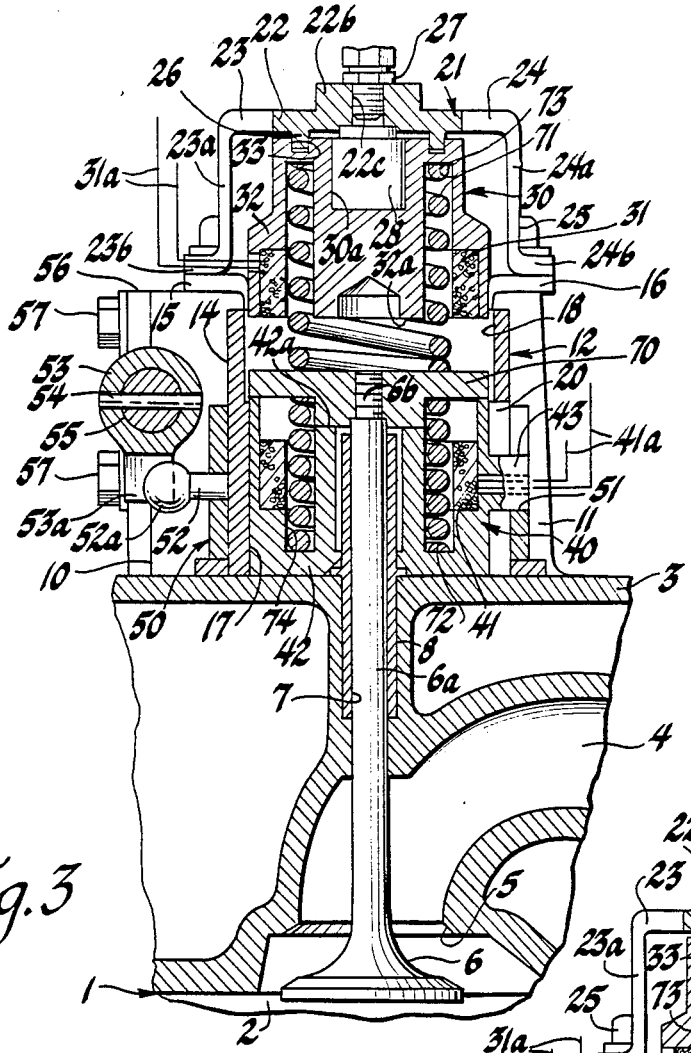
FIG. 3 is a view similar to FIG. 2 but with the elements shown in the full valve open or maximum lift position.
Figure 4:
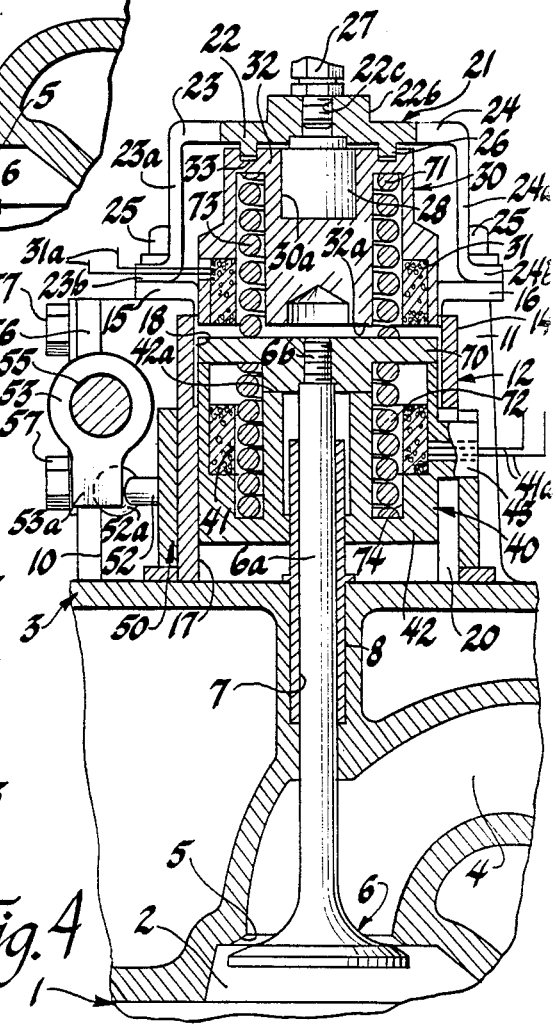
FIG. 4 is a view similar to FIG. 3 but with the lower solenoid moved axially toward the upper solenoid of the system so as to effect reduced lift of the valve in the valve open position; and, FIG. 5 is a side view of the variable lift valve actuator system, per se, illustrating the cam ring and the associate cam follower of the lower solenoid used to effect axial positioning of the lower solenoid relative to the upper solenoid.

Referring now to the drawings and, in particular, to FIGS. 2–4, there is illustrated a portion of an internal combustion engine which includes a cylinder block 1 having a combustion cylinder 2 therein and with a cylinder head 3 fixed thereto in a conventional manner. The cylinder head 3 is provided with a passage 4 therein which terminates at one end thereof in a port encircled by a valve seat 5. Flow through the passage 4 is controlled by a poppet valve 6, either inlet or exhaust, that has its stem end 6*a* reciprocably guided in a suitable stem guide bore 7, as provided, in part in the construction shown, by an elongated stem guide bushing 8 suitably fixed in the cylinder head 3 so that a portion thereof extends above the normal upper surface of the cylinder head 3 with the stem end 6a of the poppet valve 6 extending through and upward therefrom.

Figure 5:
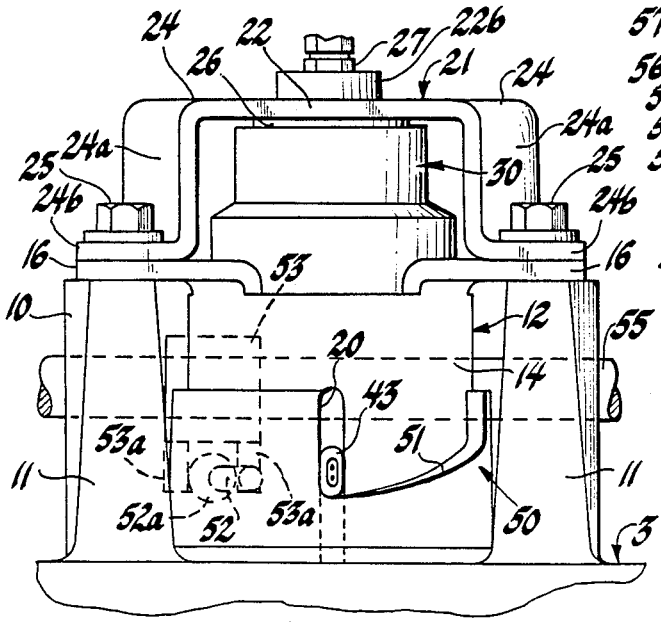

In the construction shown, the cylinder head 3 is also provided with two sets of upright pillars 10 and 11, respectively, which extend to a predetermined height above the cylinder head 3. Both the pillars 10 and 11 are each spaced apart a predetermined extent longitudinally, as best seen in FIG. 5, with the set of pillars 11 being spaced transversely, a predetermined amount, from the set of pillars 10, as best seen in FIGS. 1–4.

Referring now to the subject invention, there is provided a solenoid housing means, which for ease of manufacturing and assembly, includes a lower solenoid housing 12 and an upper solenoid housing 21. The lower solenoid housing 12 includes a lower tubular housing portion 14 which at its upper end is provided with integral, radial outward extending, apertured flanges 15 and 16 positioned so as to abut on top of the pillars 10 and 11, respectively. As shown in FIGS. 2–4, the lower tubular housing portion 14 is provided with a stepped bore therethrough defining, in the construction shown, an internal, circular solenoid guide or lower wall 17 and an upper wall 18 of an internal diameter greater than that of lower wall 17. In addition, the lower solenoid housing 12 is provided with at least one open, axial extending, slotted window 20 that extends circumferentially relative to and between the apertured flanges 16 for a purpose to be described.

Figure 1:
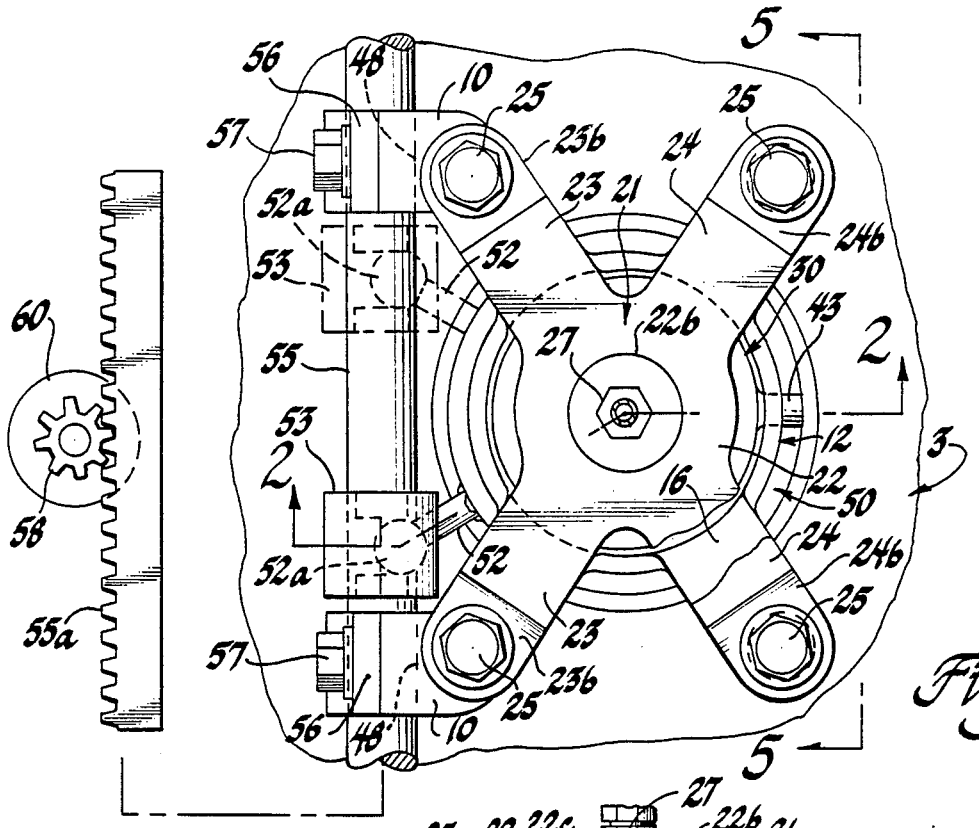
FIG. 1 is a top view of a portion of an internal combustion engine with the valve cover removed, the engine having a variable lift electromagnetic valve actuator system in accordance with the invention incorporated thereon, with the stepper actuator being shown schematically.

The upper solenoid housing 21, in the construction illustrated, includes a substantially circular base, generally designated 22 with integral, radial outward extending arms 23 and 24. Each arm 23 also includes a downward extending support leg 23a which at its lower end is outwardly bent to define an apertured flange 23b located so as to overlie in alignment with an associated apertured flange 15 of the lower housing 12 so that these elements can be secured as by a machine screw 25 threadingly received in an internally threaded bore, not shown, provided in an associate pillar 10 for this purpose. In a similar manner, each arm 24 also includes a downward extending support leg 24a which at its lower end is outwardly bent to define an apertured flange 24b located so as to overlie in alignment with an associate apertured flange 16 of the lower housing 12 so that these can be secured by a machine screw 25 threadingly received in an associated pillar 11. Thus as best seen in FIG. 1, the upper solenoid housing 21 includes a pair of arms 23 used to secure it and the lower solenoid housing 12 to the spaced apart pillars 10 and another pair of arms 24 used to secure it and the lower solenoid housing 12 to the spaced apart pillars 11.

The upper solenoid housing 21 is adapted to slidably support a first or upper electromagnet or solenoid 30, shown only schematically since such solenoids that include a solenoid coil 31 and pole piece 32 are well known in the art. For this purpose and in the construction shown, the base 22 of the upper solenoid housing 21 is provided with an annular, depending ring guide 26 slidably received in an annular groove 33 provided for this purpose in the upper surface of the upper solenoid 30. In addition base 22 preferably also includes an upstanding boss 22b with a passage means in the form of an internally threaded bore 22c through these elements so as to receive a conventional conduit connection 27 for supplying hydraulic fluid, such as engine lubricating oil, to a conventional hydraulic lash adjuster, generally designated 28 having its outer cup-shaped cylinder member operatively positioned in a blind bore 30a provided for this purpose in the upper solenoid 30. Although any conventional hydraulic lash adjuster 28 may be used and thus is not illustrated in detail herein, the lash adjuster 28 is preferably of the type disclosed in U.S. Pat. No. 3,509,858 issued May 5, 1970 to E. W. Scheibe et al, the disclosure of which is incorporated herein by reference thereto.

The lower solenoid housing 12 has a second or lower electromagnet or solenoid 40 slidably received by the internal wall 17 of its body portion 14, the lower solenoid 40, also shown schematically, includes a solenoid coil 41 and a tubular pole piece 42 adapted to encircle the guide bushing. The pole piece 42 is also provided with a radial outward extending cam follower 43 sized and configured so as to loosely project outward through the window 20 a predetermined radial extent for a purpose to be described.

The solenoids 30 and 40 are thus positioned so that the working surface 32a of the upper solenoid 30 is opposed to the stepped working surface 42a of the lower solenoid 40 whereby these solenoids are operative as two electromagnetic switching means.

In addition, if desired and as well known in the art, each of the opposed working surfaces 32a and 42a can be provided with a non-magnetic shim, not shown, so as to provide for a fixed minimum working air gap between these surfaces and the associate working surfaces of an armature 70 to be described hereinafter.

Now in accordance with a feature of the invention, a cam ring means 50 is operatively positioned to loosely encircle the lower body portion 14 of the lower solenoid housing 12 and to abut against the upper main body surface portion of the cylinder head 3, for rotative movement relative to the lower housing 12. As best seen in FIG. 4, the wall of the cam ring means 50 is provided with at least one downward extending opening of a predetermined angular extent, the lower edge defining this opening being in the form of a cam ramp 51 so that upon rotation of the cam ring means 50, the lower solenoid 40 can be moved by its cam follower 43 engaging the cam ramp 51 from the position shown in FIG. 2 axially upward toward the upper solenoid 30 or back down toward the lowered position of this lower solenoid 40 shown in FIG. 2 for purposes to be described.

For effecting such rotational movement of the cam ring means 50, in the construction shown, the cam ring means 50 has a radial outward extending actuator arm 52 suitably fixed thereto, the outer free end of the actuator arm 52 being in the form of a ball 52a. In the embodiment shown, the ball 52a is operatively trapped between the depending spaced apart legs 53a of a tubular carrier 53 which, in the embodiment shown, is fixed by a wedge pin 54 to the round end of an actuator rod 55. As shown, the actuator rod 55 is suitably journaled for reciprocation by means of spaced apart sleeve type bearings, each such bearing being defined by through bores 48, as shown in FIG. 1, at the interface between the outboard end surface of a pillar 10 and an associate bearing cap 56 fixed thereto as by machine screws 57. The actuator rod 55 at least at one end thereof, in the construction shown and as best seen in FIG. 1, is provided with a gear rack 55a in operative engagement with a pinion gear 58 suitably fixed to the shaft of, for example, a conventional electrical stepper motor 60.

The cam ring means 50 as operatively connected to the solenoid 40; the actuator arm 52; carrier 53; actuator rod 55 with its gear rack 55*a*; the pinion gear 58; and, the stepper motor 60, in the construction illustrated, define, in effect, a lower solenoid axial positioner means used to vary the axial position of the lower solenoid 40 relative to the upper solenoid 30 whereby the lift of the poppet valve 6 can be varied, as desired, as a function of engine operation in a manner to be described.

Referring now again to FIGS. 2–4, the upper and lower solenoids 30 and 40, respectively, have the working surface 32*a* and 42*a* of their pole pieces 32 and 42, respectively in opposed, spaced part relationship to each other so that each such pole piece 32 or 42 can effect movement of an armature 70 suitably fixed to the free stem 6*a* end of the poppet valve 6. For this purpose in the construction shown, the armature 70 is provided with a central internally threaded bore to receive the externally threaded portion 6*b* of the poppet valve. Also as shown, the armature has a flat working surface opposed to the working surface 32*a* and a stepped working surface opposed to the stepped working surface 42*a*.

With this arrangement, the armature 70 is operatively positioned in the solenoid means intermediate the working surfaces 32*a* and 42*a* of the pole pieces 32 and 42, respectively.

In addition, the opposite surfaces of the armature 70 are acted upon by first and second valve springs 71 and 72, respectively, that are operatively and loosely received in annular grooves 73 and 74 provided for this purpose in the upper and lower solenoids 30 and 40, respectively. Accordingly, with reference to the position of the solenoids shown in FIGS. 3 and 4, if both of the solenoid coils 31 and 41 are deenergized, the forces of the springs 71 and 72 would be such so as to act on the armature 70 whereby it would be positioned substantially mid-way between the opposed working faces 32*a* and 42*a* of the pole pieces 32 and 42, respectively.

Now with reference to the embodiment shown, the stepper motor 60 and the leads 31*a* and 41*a* of the solenoid coils 31 and 41, respectively, which extend out through suitable apertures, not numbered, provided for this purpose in the pole pieces 32 and 42, respectively, are each suitably connected to a source of electrical power as controlled by an electronic control unit, such as a vehicle onboard computer, in a manner well known in the fuel injection art. Also as well known in the art, the computer is supplied with electrical signals regarding various engine operating conditions and with a signal corresponding to the accelerator pedal position.

FUNCTIONAL DESCRIPTION

Now assuming that the engine is operating at full load and that the cam ring 50 is in the angular position shown in FIGS. 1 and 5, and that the solenoid coils 31 and 41 are sequentially being energized or deenergized, as desired, during engine operation so as to operate as an electromagnetic switch means.

Accordingly, when the solenoid coil 31 is energized and solenoid coil 41 is deenergized, the armature 70 would be attracted toward the pole piece 32 to the position shown in FIG. 2, a position at which the poppet valve 6 is moved to the valve closed position. In this position of the armature 70, the associate spring 71 in the upper solenoid 30 is compressed as shown in FIG. 2 and is trapped within this solenoid by the armature 70.

Accordingly, thereafter, as the solenoid coil 31 is then deenergized and solenoid coil 41 is energized, the armature 70 is initially moved toward the pole piece 42 by the force of the spring 71 which is then no longer trapped, so that as the armature 70 is axially moved in a direction toward the lower solenoid 40 and as it approaches the pole piece 42 it is then, in effect, captured by the pole piece 42, since the associate solenoid coil 41 is now energized, and thus moves to the position shown in FIG. 3, a position at which the poppet valve 6 is in a full open position, that is, at maximum valve lift.

In a similar manner, when the solenoid coil 41 is then again deenergized, the spring 72, having previously been compressed and captured within the lower solenoid 40 in the manner as described relative to spring 71, during the above-described valve open process, will accelerate the movement of the armature 70 toward the pole piece 32 in a valve closing direction so that upon energization of the solenoid coil 31, the armature 70 will again be moved from the position shown in FIG. 3 back to the position shown in FIG. 2, a position at which the poppet valve 6 is again in a valve closed position.

It will be appreciated that during the above operating cycle from a valve closed position to a valve open position and back to a valve closed position, the lash adjuster 28 is operative to compensate for any change in the poppet valve 6 length. Thus, during a valve opening movement, hydraulic fluid is trapped in the pressure chamber, not shown, of the lash adjuster 28. However, as the armature 70 is again moved toward a valve closed position so that it engages the upper solenoid 30 assembly, the spring 71 is, in effect, trapped by the armature 70 in this solenoid assembly, thus allowing spring 72 to force the armature 70 and the upper solenoid 30 axially upward, if necessary, whereby to allow for the collapse of the lash adjuster 28 by the normal leak-down of hydraulic fluid from its pressure chamber, not shown, in a known manner so as to insure positive seating of the poppet valve 6 against the valve seat 5.

On the other hand, if the poppet valve 6 seats and lash adjustment is required, then hydraulic fluid can flow into the pressure chamber, not shown, in a manner well known in the art, as disclosed, for example, in the above-identified U.S. Pat. No. 3,509,858, so as to effect axial downward movement of the upper solenoid 30 to take up such lash.

In addition, during engine operation, the stepper motor 60 can be energized as a function of the engine operating conditions so as to vary the lift of the poppet valve 6, as desired, from the full open position of the poppet valve shown in FIG. 3 by axial movement of the lower solenoid 40 by means of the cam ring 50 and the associate cam follower 43 of the lower solenoid 40.

Thus as shown in FIG. 4, the cam ring 50 can be angularly positioned so as to move the lower solenoid 40 axially upward toward the upper solenoid 30, such that when the upper solenoid coil 31 is deenergized and the solenoid coil 41 is energized to operatively hold the armature 70 to the pole piece 42 of the lower solenoid 40, the lift of the poppet valve 6 is reduced, as desired, as shown in FIG. 4. For example, if the poppet valve 6 is an intake valve, this valve open position shown in FIG. 4 could correspond substantially to an engine idle operation position.

It should be appreciated that since the spring 72 is carried at one end in the lower solenoid 40, it will move with this solenoid 40 as it is moved from the position shown in FIGS. 2 and 3 to the position shown in FIG. 4. Accordingly, when the armature 70 is operatively engaged by the pole piece 42 upon energization of the solenoid coil 41 of the lower solenoid 40, the spring 72 is compressed and held captive in the lower solenoid 40 whereby it is again in an operative position to effect, upon deenergization of the solenoid coil 41 movement of the armature 70 in an axial direction toward the upper solenoid 30 in a manner as previously described.

In addition to the above-described operation of the subject variable lift solenoid actuator system, during each engine operation cycle, the onboard computer, not shown, is programmed so as to actuate the stepper motor 60 to drive the pinion 58 and rack 55*a* in an axial direction to effect rotation of the cam ring 50 via the actuator arm 52 in a clockwise direction with reference to FIG. 1 so that the actuator arm 52 moves from the position shown by solid lines to the position shown by the broken lines in this Figure during engine shut-down.

This rotation of the cam ring 50 will raise the lower solenoid 40 whereby the armature 70 will be closely adjacent to the working surface of the upper solenoid 30 pole piece 32, and the working surface of the lower solenoid 40 pole piece 42. Accordingly, with this arrangement, at engine start up, the poppet valve 6 can be moved to a valve closed position by energizing the solenoid coil 31 of the upper solenoid 30 or to a part valve open position by energizing the solenoid coil 41 of the lower solenoid 40, since the working air gap between either pole pieces 32 and 42 with respect to the armature 70 is relatively narrow.

Of course in an actual engine all of the poppet valves could be moved initially to a valve closed position, if desired, by energizing all of the solenoid coils 31 of the upper solenoids 30 so that in the next step in the starting sequence all of the poppet valves of the engine that are to be opened for a particular crankshaft position will be opened by deenergizing the associate solenoid coils 31 of the associate upper solenoids 30 and energizing the associate solenoid coils 41 of the associate lower solenoids 40.

It should now be apparent that with the variable lift electromagnets valve actuator system of the invention, this actuator system is capable of independent control of valve lift, duration, and timing.

While the invention has been described with reference to the structures and mode of operation for engine start-up disclosed herein, it is not confined to the specific details set forth, since it is apparent that many modifications and changes can be made by those skilled in the art. For example, in lieu of the cam arrangement disclosed to effect axial positioning of the lower solenoid, it would be apparent to use a lever means, not shown, to accomplish the same type of axial movement and positioning of the lower solenoid. This application is therefore intended to cover such modifications or changes as may come within the purposes of the improvements or scope of the following claims.

The embodiments of the invention in which an exclusive property or privilege is claimed are defined as follows:

1. A variable lift, solenoid, valve actuator for a reciprocating internal combustion engine of the type having an engine block means defining a cylinder with a port and a poppet valve having a valve stem reciprocably journaled in the engine block means to control flow through the port and having the free end of the valve stem extending outward from the engine block means: said valve actuator including a solenoid housing means operatively secured to said engine block means concentrically around said valve stem; a first solenoid and a second solenoid, each including a solenoid coil and pole piece, operatively positioned in spaced apart relationship in said solenoid housing means whereby the working pole piece surfaces of said pole pieces of said first and second solenoids are opposed to each other and wherein said second solenoid is positioned so as to loosely encircle said valve stem with a portion of said valve stem extending therethrough toward said working pole piece surface of said first solenoid; an armature secured to said portion of said valve stem and operatively positioned in said solenoid housing means for reciprocable movement between said opposed working pole piece surfaces; first and second spring means carried by said first and second solenoids, respectively, and operatively engaging opposite sides of said armature; and, a solenoid axial positioning means operatively connected to said second solenoid to effect axial movement of said second solenoid relative to said first solenoid whereby the lift of the poppet valve can be varied as desired, and thus allows said second solenoid to be moved toward said first solenoid, as at the end of an engine operation cycle by said solenoid axial positioning device whereby the axial extent between said opposed working surfaces of said pole pieces of said first and second solenoids and therefor the operating gap between said armature and said opposed working surfaces is substantially reduced to thereby permit said poppet valve to be easily moved to a valve closed position or a valve open position by normal energization of either said first solenoid or said second solenoid, respectively, as desired, during the start of the next engine operation cycle.

2. A variable lift, solenoid, valve actuator according to claim 1 wherein said first solenoid has a blind bore in an end opposite said working pole piece, a hydraulic lash adjuster operatively positioned in said blind bore and wherein said solenoid housing means includes a passage means at one end thereof for use in supplying hydraulic fluid to said hydraulic lash adjuster, said one end of said solenoid housing means and said end of said first solenoid including associate guide means for axial guiding movement of said first solenoid as controlled by said hydraulic lash adjuster.

3. A variable lift, solenoid, valve actuator system for a reciprocating internal combustion engine of the type having an engine block means defining a cylinder with a port and a poppet valve having a valve stem reciprocably journaled in the engine block means to control flow through the port and having the free end of the valve stem extending outward from the engine block means: said valve actuator system including a solenoid housing means operatively secured to said engine block means concentrically around said valve stem; a first solenoid and a second solenoid, each including a solenoid coil adapted to be connected to a source of electrical power as controlled by an electronic control means, and pole piece, said first and second solenoids being operatively positioned in axial spaced apart relationship in said solenoid housing means whereby the working pole piece surfaces of said pole pieces of said first and second solenoids are opposed to each other and wherein said second solenoid loosely encircles said valve stem; an armature secured to said valve stem and operatively positioned in said solenoid housing means for reciprocable movement between said opposed working pole piece surfaces; first and second spring means carried by said first and second solenoids, respectively, and operatively engaging opposite sides of said armature; and, a solenoid axial positioning means operatively connected to said second solenoid to effect axial movement of said second solenoid relative to said first solenoid whereby the lift of the poppet valve can be varied as desired, said solenoid axial positioning means including an electrical stepper means adapted to be connected to a source of electrical power as controlled by an electronic control means, the arrangement being such that the actuator system is operative to vary the poppet valve lift, duration, and timing.

4. A variable lift, solenoid, valve actuator system according to claim 3 wherein said first solenoid has a blind bore in an end opposite said working pole piece, a hydraulic lash adjuster operatively positioned in said blind bore and wherein said solenoid housing means includes a passage means at one end thereof for use in supplying hydraulic fluid to said hydraulic lash adjuster, said one end of said solenoid housing means and said end of said first solenoid including associate guide means for axial guiding movement of said first solenoid as controlled by said hydraulic lash adjuster.

5. A variable lift, solenoid, valve actuator system for a reciprocating internal combustion engine of the type having an engine block means defining a cylinder with a port and a poppet valve having a valve stem reciprocably journaled in the engine block means to control flow through the port and having the free end of the valve stem extending outward from the engine block means: said valve actuator including a solenoid housing means, including an upper portion and a lower portion, operatively secured to said engine block means concentrically around said valve stem; a first solenoid and a second solenoid, each including a solenoid coil and pole piece, operatively positioned in spaced apart relationship in said upper and lower portions, respectively, of said solenoid housing means whereby the working pole piece surfaces of said pole pieces of said first and second solenoid are opposed to each other and wherein said second solenoid is positioned so as to loosely encircle said valve stem; an armature secured to said valve stem and operatively positioned in said solenoid housing means for reciprocable movement between said opposed working pole piece surfaces; first and second spring means carried by said first and second solenoids, respectively, and operatively engaging opposite sides of said armature; and, a solenoid axial positioning means operatively connected to said second solenoid to effect axial movement of said second solenoid relative to said first solenoid whereby the lift of the poppet valve can be varied as desired, said solenoid axial position means including a cam ring means operatively encircling said lower portion of said solenoid housing means and operatively connected to said second solenoid to effect axial movement of said second solenoid upon angular movement of said cam ring means and, an electrical stepper means operatively connected to said cam ring means to effect angular movement of said cam ring means, said electrical stepper means and said solenoid coils of said first and second solenoids being adapted to be connected to a source of electrical power as controlled by an electronical control unit whereby the poppet valve lift, duration and timing can be controlled as a function of engine operation.

6. A variable lift, solenoid, valve actuator according to claim 5 wherein said first solenoid has a blind bore in an end opposite said working pole piece, a hydraulic lash adjuster operatively positioned in said blind bore and wherein said upper portion of said solenoid housing means includes a passage means at one end thereof for use in supplying hydraulic fluid to said hydraulic lash adjuster, said one end of said solenoid housing means and said end of said first solenoid including associate guide means for axial guiding movement of said first solenoid as controlled by said hydraulic lash adjuster.

* * * * *